US009914585B1

(12) United States Patent
Alberti et al.

(10) Patent No.: US 9,914,585 B1
(45) Date of Patent: Mar. 13, 2018

(54) DEBRIS CATCHER

(71) Applicants: Dan Alberti, Fairfield, NJ (US); Ronald Thomson, Fairfield, NJ (US)

(72) Inventors: Dan Alberti, Fairfield, NJ (US); Ronald Thomson, Fairfield, NJ (US)

( * ) Notice: Subject to any disclaimer, the term of this patent is extended or adjusted under 35 U.S.C. 154(b) by 0 days.

(21) Appl. No.: 15/244,128

(22) Filed: Aug. 23, 2016

(51) Int. Cl.
*B65D 33/14* (2006.01)
*B65F 1/00* (2006.01)
*B65F 1/16* (2006.01)

(52) U.S. Cl.
CPC ..... *B65F 1/0013* (2013.01); *B65F 1/002* (2013.01); *B65F 1/1615* (2013.01); *B65F 1/1623* (2013.01); *B65F 2210/18* (2013.01)

(58) Field of Classification Search
CPC ..... B65F 1/0013; B65F 1/002; B65F 1/1615; B65F 1/1623; B65F 2210/18
USPC ..... 383/11, 33–34.1, 120
See application file for complete search history.

(56) References Cited

U.S. PATENT DOCUMENTS 2,689,594 A 9/1954 Wendt
2,774,531 A * 12/1956 Rosenthal ..... B65D 33/00 206/554
2,861,735 A * 11/1958 Faltin ..... B65D 33/14 206/806
2,925,172 A * 2/1960 Hopp ..... B60N 3/08 224/483
3,133,690 A * 5/1964 Lui ..... B60N 3/08 383/106
3,426,958 A * 2/1969 Gore ..... B65D 33/14 206/806
3,561,670 A * 2/1971 Segal ..... A24F 19/0028 206/246
4,515,504 A 5/1985 Moore, Sr.
5,911,324 A * 6/1999 Hammer ..... B23Q 11/0053 206/460
5,915,839 A * 6/1999 Dennis ..... B65D 33/14 383/11
D419,301 S 1/2000 Hampshire
6,550,967 B2 * 4/2003 Hedaya ..... A45C 13/004 383/127
6,698,927 B2 * 3/2004 Hedaya ..... A45C 13/004 383/127
9,072,423 B1 7/2015 Columbo
2004/0120607 A1 6/2004 Goren
2009/0035077 A1 2/2009 Aley
2016/0015388 A1 * 1/2016 Ren ..... A61B 17/06161 383/33
2016/0107833 A1 * 4/2016 Schvey ..... B65F 1/0013 383/120

FOREIGN PATENT DOCUMENTS

WO 2000005031 A1 2/2000

* cited by examiner

*Primary Examiner* — Jes F Pascua
(74) *Attorney, Agent, or Firm* — Kyle A. Fletcher, Esq.

(57) ABSTRACT

The debris catcher is a waste receptacle that is adapted for use with a drill. The debris catcher is further adapted for use with a wall. The debris catcher captures and removes the waste generated by a drill when the drill is used to drill a hole in a wall. The debris catcher is a collection bag that is attached to the wall underneath drill site such that debris generated from the drill site will fall into the debris catcher. The debris catcher comprises a collection bag, a first adhesive, a second adhesive, and a plurality of spring loaded clips.

11 Claims, 7 Drawing Sheets

DEBRIS CATCHER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of containers for conveying, packing, or storing materials, more specifically, a sack, a bag, or other container with a suspension means.

SUMMARY OF INVENTION

The debris catcher is a waste receptacle that is adapted for use with a drill. The debris catcher is further adapted for use with a wall. The debris catcher captures and removes the debris generated by a drill when the drill is used to drill a hole in a wall. The debris catcher is a collection bag that is attached to the wall underneath drill site such that debris generated from the drill site will fall into the debris catcher.

These together with additional objects, features and advantages of the debris catcher will be readily apparent to those of ordinary skill in the art upon reading the following detailed description of the presently preferred, but nonetheless illustrative, embodiments when taken in conjunction with the accompanying drawings.

In this respect, before explaining the current embodiments of the debris catcher in detail, it is to be understood that the debris catcher is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the debris catcher.

It is therefore important that the claims be regarded as including such equivalent construction insofar as they do not depart from the spirit and scope of the debris catcher. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
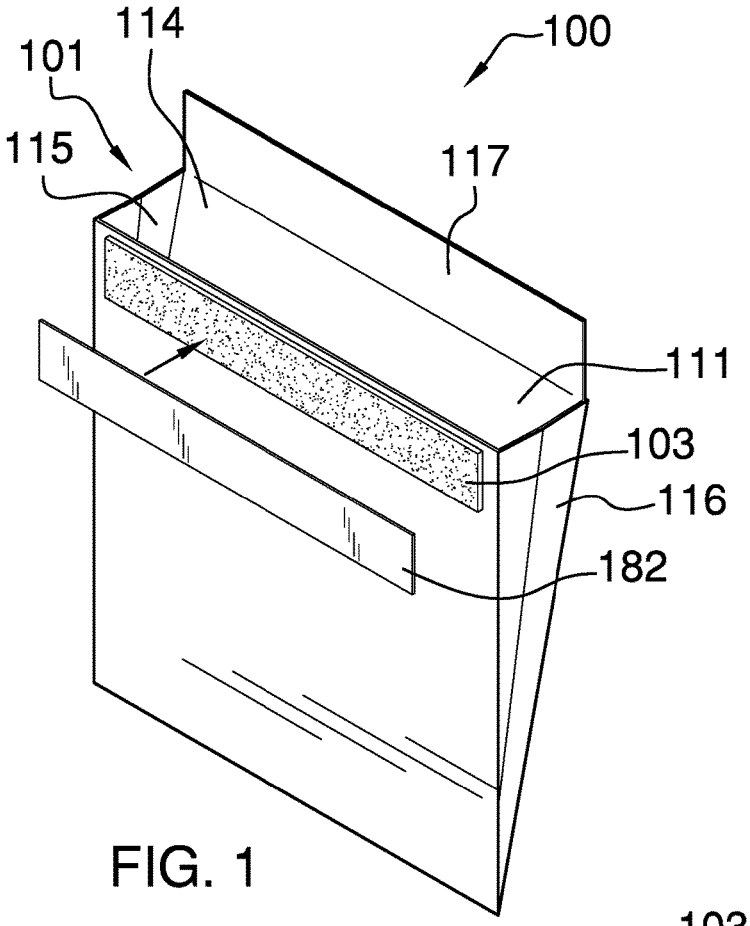
FIG. 1 is a perspective view of an embodiment of the disclosure.
Figure 2:
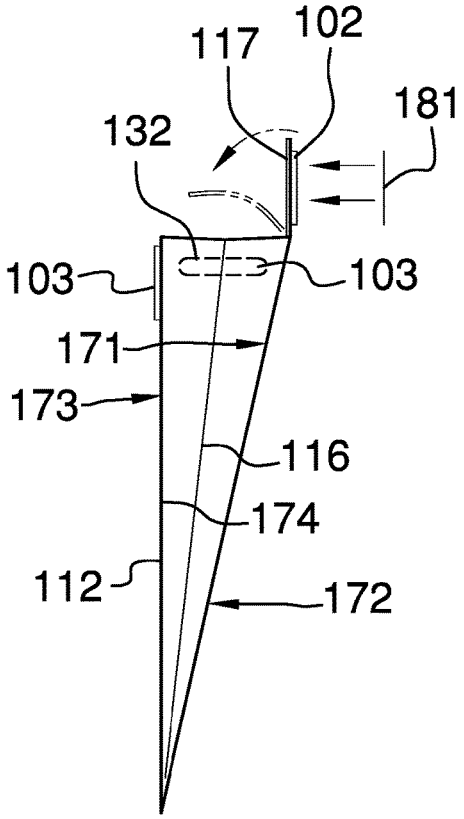
FIG. 2 is a side view of an embodiment of the disclosure.
Figure 3:
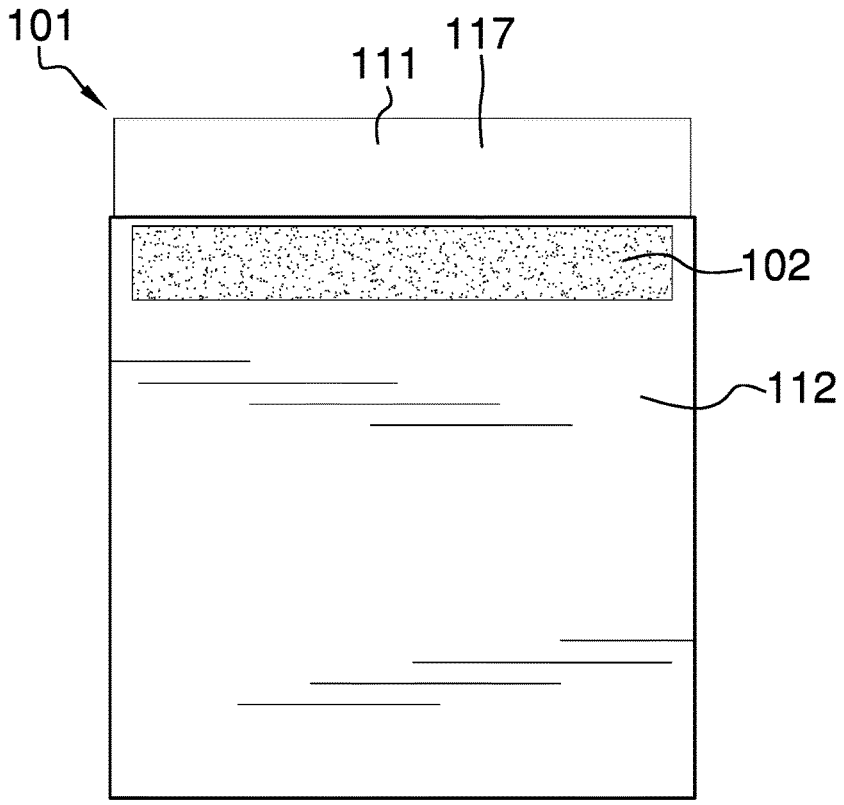
FIG. 3 is a front view of an embodiment of the disclosure.
Figure 4:
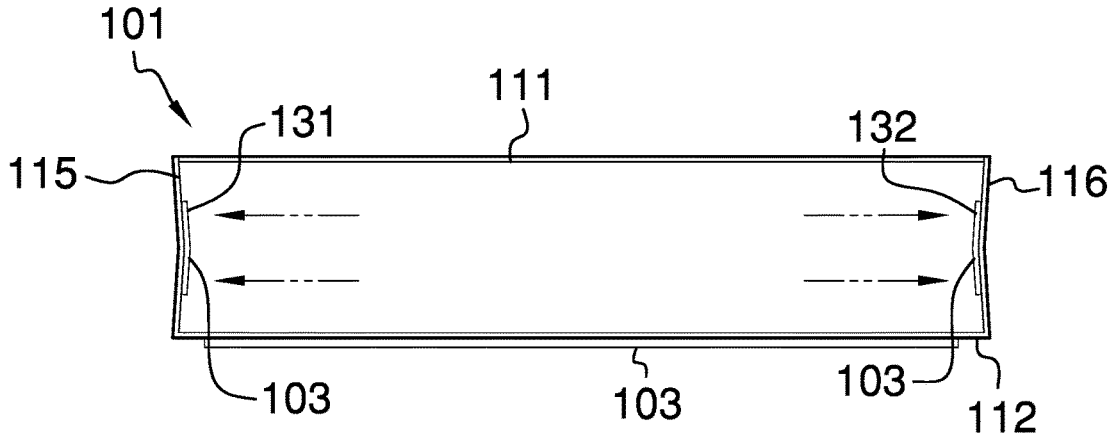
FIG. 4 is a top view of an embodiment of the disclosure.
Figure 5:
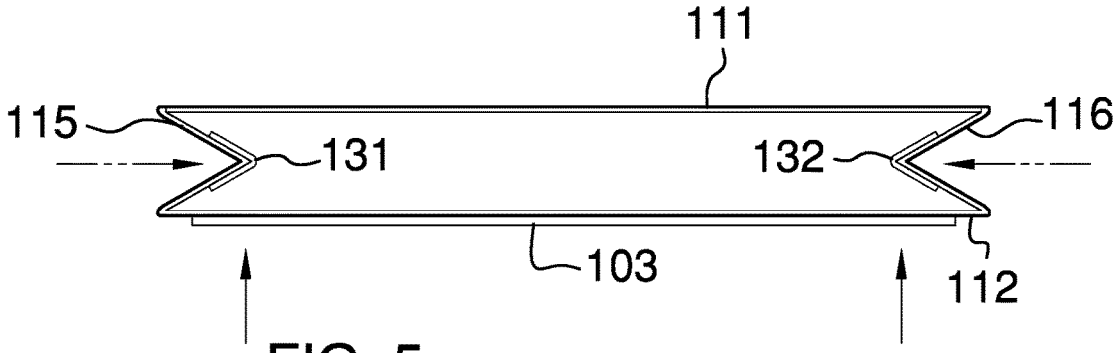
FIG. 5 is a top view of an embodiment of the disclosure.
Figure 6A:
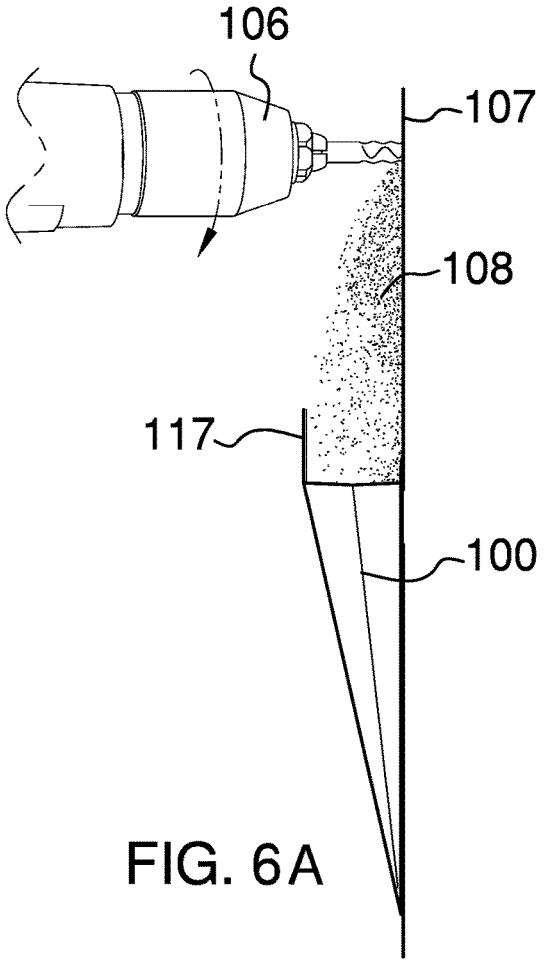
FIG. 6A is an in use view of an embodiment of the disclosure.
Figure 6B:
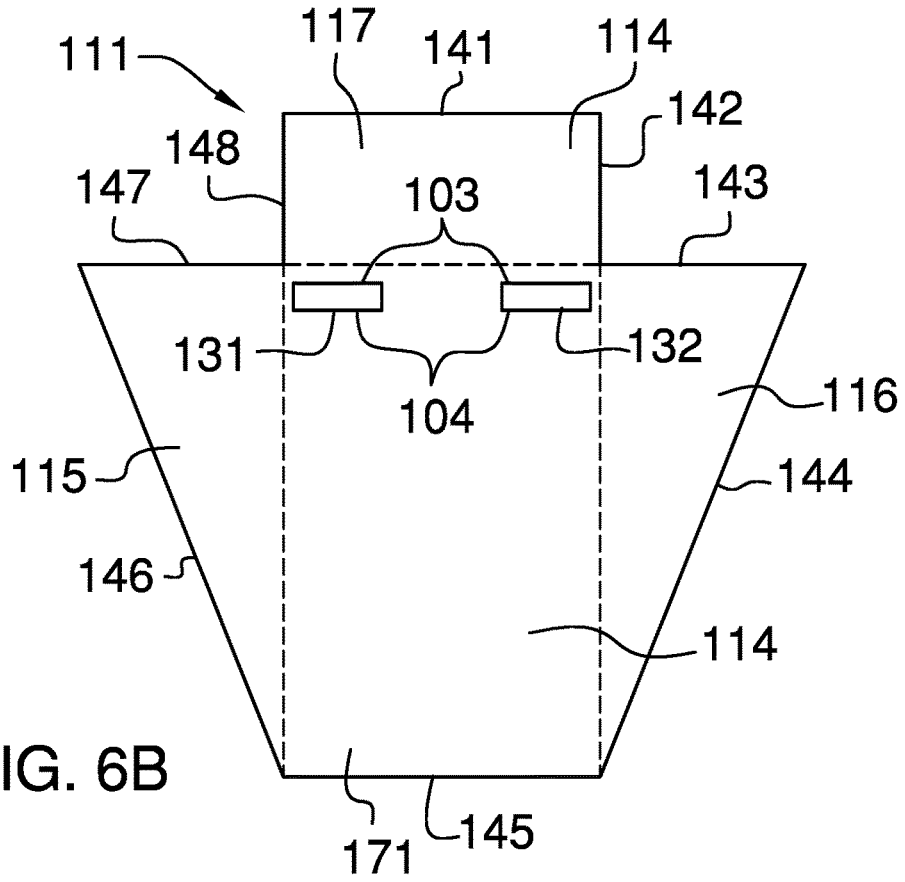
FIG. 6B is a detail view of an embodiment of the disclosure.
Figure 6C:
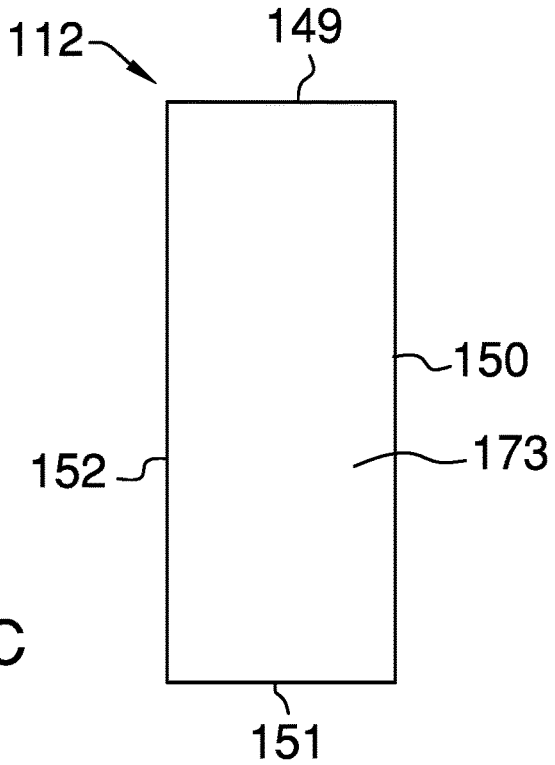
FIG. 6C is a detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 9.

The debris catcher 100 (hereinafter invention) comprises a collection bag 101, a first adhesive 102, a second adhesive 103, and a plurality of spring-loaded clips 104. The first adhesive 102, the second adhesive 103, and the plurality of spring loaded clips 104 are attached to the collection bag. The invention 100 is a waste receptacle that is adapted for use with a drill 106. The invention 100 is further adapted for use with a wall 107. The invention 100 captures and removes debris 108 generated via a drill 106 when the drill 106 is used to form a hole in a wall 107. The invention 100 is a collection bag 101 that is attached to the wall 107 underneath drilling site such that debris 108 generated from the drill 106 will fall into the invention 100. The invention 100 is intended to be disposable.

The collection bag 101 comprises a first panel 111, a second panel 112, and a plurality of seams 113. The plurality of seams 113 joins the first panel 111 and the second panel 112.

In the first potential embodiment of the disclosure, the first panel 111 is formed from a sheeting material that is roughly formed in the shape of an architectural structure commonly referred to as a keystone. As shown most clearly in FIG. 7A, the first panel 111 is formed in the shape of a base rectangle 114, a first triangle 115, and a second triangle 116. The first panel 111 is further defined with a first edge 141, a second edge 142 a third edge 143, a fourth edge 144, a fifth edge 145, a sixth edge 146, a seventh edge 147, an eighth edge 148, a first surface 171, and a second surface 172. The first triangle 115 and the second triangle 116 are attached to opposite edges of the base rectangle 114. The first triangle 115 is a right triangle formed by the sixth edge 146 and the seventh edge 147 of the first panel 111. The sixth edge 146 is the hypotenuse of the first triangle 115. The second triangle 116 is a right triangle formed by the fourth edge 144 and the third edge 143 of the first panel 111. The fourth edge 144 is the hypotenuse of the second triangle 116. The third edge 143 and the seventh edge 147 are aligned such that if the third edge 143 and the seventh edge 147 were extended they would form a single line. As shown most clearly in FIG. 7A, the first edge 141, the second edge 142, the eighth edge 148 and a line drawn from the third edge 143 to the seventh edge 147 creates a rectangular sub-section contained within the base rectangle 114 called the flap rectangle 117. The flap rectangle 117 is discussed in more detail elsewhere in this disclosure.

Figure 7A:
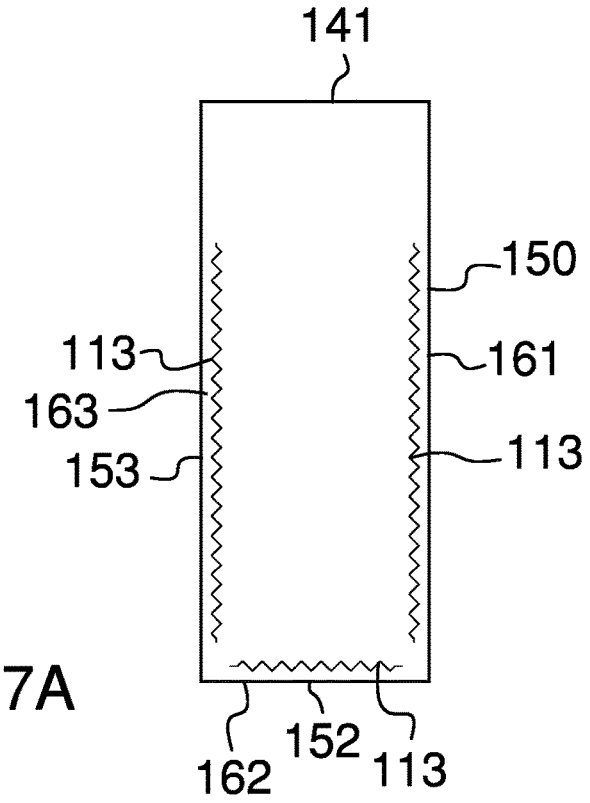
FIG. 7A is a detail view of an embodiment of the disclosure.
Figure 7B:
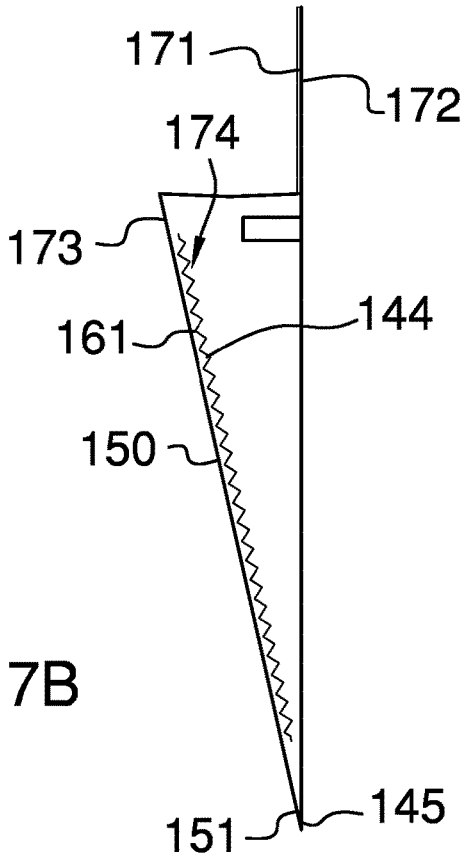
FIG. 7B is a detail view of an embodiment of the disclosure.

In the first potential embodiment of the disclosure, the second panel 112 is formed from a sheeting material that is formed in the shape of a rectangle. The sheeting material used in the second panel 112 is the same as the sheeting material used in the first panel 111. As shown in FIG. 7B, the second panel 112 is further defined with a ninth edge 149, a tenth edge 150, an eleventh edge 151, a twelfth edge 152, a third surface 173, and a fourth surface 174.

In the first potential embodiment of the disclosure, the plurality of seams 113 comprises a first seam 161, a second seam 162, and a third seam 163.

Figure 8A:
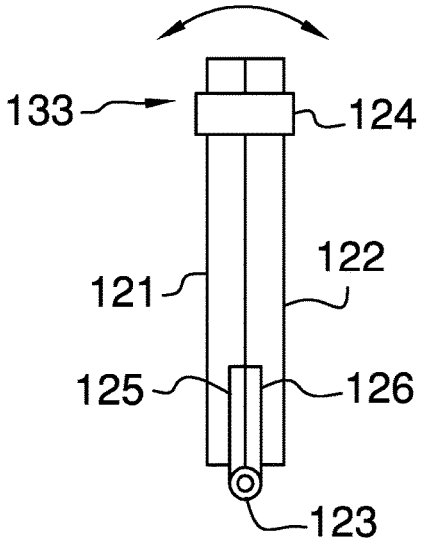
FIG. 8A is a detail view of an embodiment of the disclosure.
Figure 8B:
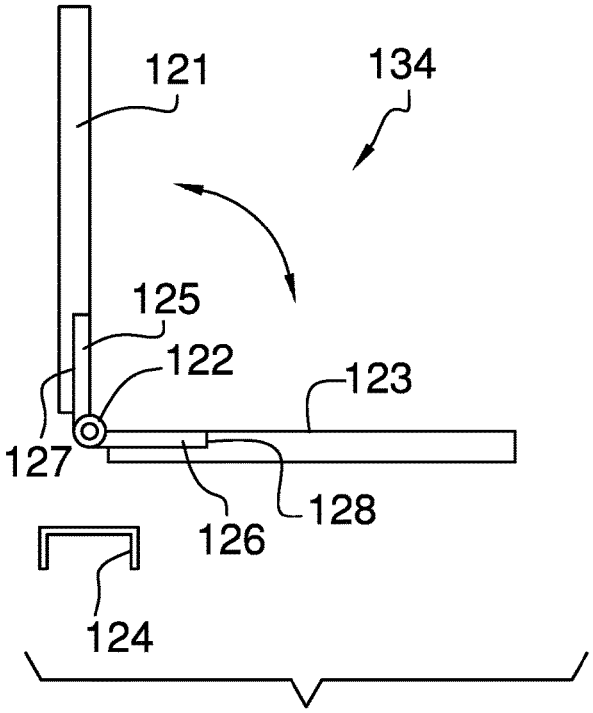
FIG. 8B is a detail view of an embodiment of the disclosure.
Figure 8C:
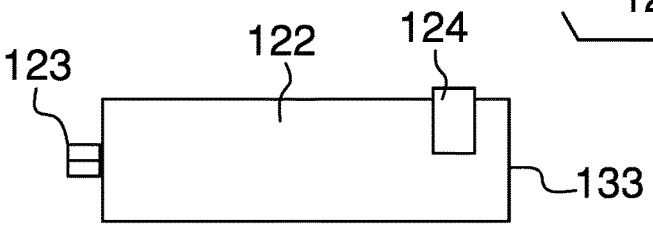
FIG. 8C is a detail view of an embodiment of the disclosure.
Figure 9:
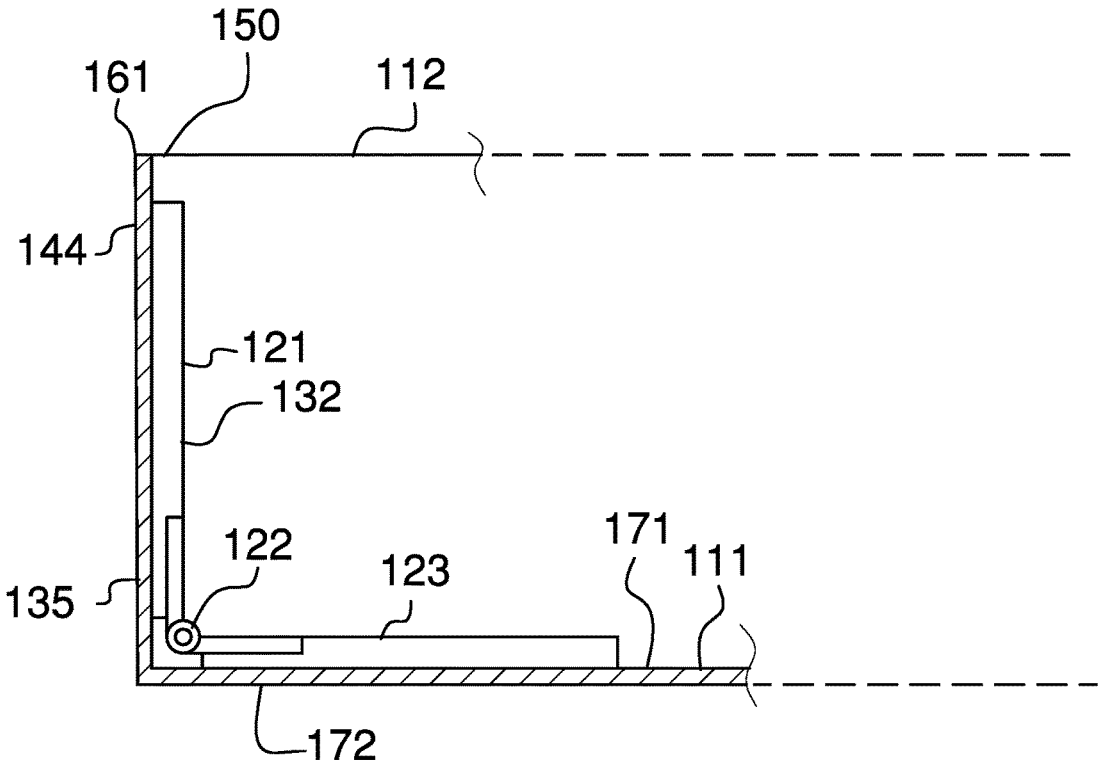
FIG. 9 is a top view of an embodiment of the disclosure in use.

In the first potential embodiment of the disclosure, as shown most clearly in FIGS. 8A and 8B, the collection bag 101 is assembled as described in this paragraph. The first panel 111 and the second panel 112 are joined such that the first surface 171 is proximal to the fourth surface 174. The first seam 161 joins the fourth edge 144 and the tenth edge 150. The second seam 162 joins the fifth edge 145 and the eleventh edge 151. The third seam 163 joins the sixth edge 146 and the twelfth edge 152. Potential methods to form the plurality of seams 113 include, but are not limited to heat bonded seams, ultrasonically bonded seams, or an adhesive seams.

Each of the plurality of spring-loaded clips 104 is a spring loaded device that is designed to hold the collection bag 101 open during use. As shown most clearly in FIGS. 4, 7A, and 10, each spring loaded clip selected from the plurality of spring-loaded clips 104 is attached to the first surface 171 of the first panel 111. Each of the plurality of spring-loaded clips 104 is further defined with a closed position 133 and an open position 134. Maximum torsional energy is stored within each spring-loaded clip selected from the plurality of spring loaded clips 104 when the selected loaded clip is in the closed position 133. When the selected spring loaded clip is released into the open position 134, the selected spring loaded clip moves to its relaxed shape, which is configured to hold the collection bag 101 open during use. Several commercially available devices are suitable for use as the spring-loaded clips contained with the plurality of spring-loaded clips 104. One potential design, which is used in the first potential embodiment of the disclosure, is described elsewhere in this disclosure.

In the first potential embodiment of the disclosure, as shown most clearly in FIGS. 9A, 9B, and 9C, each spring loaded clip selected from the plurality of spring loaded clips 104 comprises a first arm 121, a second arm 122, a spring 123 and a retaining clip 124. The first arm 121 and the second arm 122 are attached to the spring 123. The retaining clip 124 holds the selected spring-loaded clip in the closed position 133.

The spring 123 is a commercially available torsion spring. The spring 123 is further defined with a first spring shaft 125 and a second spring shaft 126. In its relaxed shape, as shown most clearly in FIG. 9B, the center axis of the first spring shaft 125 and the center axis of the second spring shaft 126 are perpendicular to each other. Maximum torsional energy is stored with the spring 123 when the center axis of the first spring shaft 125 is parallel to the center axis of the second spring shaft 126.

The first arm 121 is a first rectangular block structure that is further formed with a first hole 127. The first hole 127 is sized to receive the first spring shaft 125. The second arm 122 is a second rectangular block structure that is further formed with a second hole 128. The second hole 128 is sized to receive the second spring shaft 126. When spring 123 is positioned such that the first arm 121 and the second arm 122 are in contact, as shown most clearly in FIG. 9A, any spring loaded clip selected from the plurality of spring loaded clips 104 will be in the closed position 133.

As shown most clearly in FIGS. 9A, 9B, and 9C, any spring loaded clip selected from the plurality of spring loaded clips 104 is held in the closed position using the retaining clip 124. The retaining clip 124 is a U shaped structure that is designed to fit over the first arm 121 and the second arm 122 when the first arm 121 is touching the second arm 122 such that the retaining clip 124 will hold the selected spring loaded clip in the closed position 133. As shown most clearly in FIGS. 9B and 10, when the retaining clip 124 is removed from the first arm 121 and the second arm 122, the selected spring loaded clip moves to the open position 134 thereby expanding the collection bag 101.

The plurality of spring-loaded clips 104 further comprises a first spring-loaded clip 131 and a second spring loaded clip 132. As shown most clearly on FIGS. 2, and 7A, the first arm 121 of the first spring loaded clip 131 and the second arm 122 of the first spring loaded clip 131 are attached to the first surface 171 of the first panel 111 such that the first spring loaded clip 131 will extend the first triangle 115 at an angle perpendicularly away from the base rectangle 114 and therefore, as will be explained elsewhere in this disclosure, the wall 107. The first spring-loaded clip 131 is attached to the first panel 111 using a third adhesive. As shown most clearly on FIGS. 2, 7A, and FIG. 10, the first arm 121 of the second spring loaded clip 132 and the second arm 122 of the second spring loaded clip 132 are attached to the first surface 171 of the first panel 111 such that the second spring loaded clip 132 will extend the second triangle 116 at an angle perpendicularly away from the base rectangle 114 and therefore, as will be explained elsewhere in this disclosure, the wall 107. The second spring-loaded clip 132 is attached to the first panel 111 using a fourth adhesive 135.

The first adhesive 102 is a commercially available adhesive that is applied to the second surface 172 of the first panel 111. In the first potential embodiment of the disclosure, the first adhesive 102 is a pressure sensitive removable adhesive that is used to attach the collection bag 101 to the wall 107. The first adhesive 102 further comprises a first protective strip 181. The first protective strip 181 is a silicone treated paper strip that is placed over the first adhesive 102 to protect the first adhesive 102 from humidity and dirt.

The second adhesive 103 is a commercially available adhesive that is applied to the third surface 172 of the second panel 112. In the first potential embodiment of the disclosure, the second adhesive 103 is a pressure sensitive removable adhesive that is used to seal the collection bag 101. The second adhesive 103 further comprises a second protective strip 182. The second protective strip 182 is a silicone treated paper strip that is placed over the second adhesive 103 to protect the second adhesive 103 from humidity and dirt.

To use the first potential embodiment of the disclosure, the first protective strip 181 is removed to expose the first adhesive 102 such that the first adhesive 102 can attach the second surface 172 of the flap rectangle section 117 of the first panel 111 to the wall 107 at a position underneath the intended drilling site. The first retaining clip 124 of the first spring loaded clip 131 is removed thus allowing the first spring loaded clip 131 to extend the collection bag 101 when it relaxes to the open position 134. The first retaining clip 124 of the second spring loaded clip 132 is removed thus allowing the second spring loaded clip 132 to extend the collection bag 101 when it relaxes to the open position 134. The invention 100 is then in a position to collect debris 108 from the drill's 106 activity. Once completed, the second protective strip 182 is removed exposing the second adhesive 103. The first surface 171 of the flap rectangle 117 is folded over and pressed against the second adhesive 103 such that the flap rectangle 117 will seal the debris 108 within the collection bag 101. The invention 100 is then disposed of normally.

In the first potential embodiment of the disclosure, the first panel 111 and the second panel 112 are formed from plastic sheeting. Each of the plurality of seams 113 is a heat-bonded seam. The first arm 121, the second arm 122, and the retaining clip 124 of each of the plurality of spring loaded clips 104 is formed from molded plastic. The spring 123 is a commercially available torsion spring. The first adhesive 102 and the second adhesive 103 are commercially available rubber based pressure sensitive adhesive. The third adhesive and the fourth adhesive 135 comprise a cyanoacrylate based adhesive.

A second potential embodiment of the disclosure is a simplified version of the first potential embodiment of the disclosure. In the second potential embodiment of the disclosure, the first panel 111 and the second panel 112 are formed from paper. A paper weight equivalent of 20 pound bond is recommended and a paper weight equivalent of 28 pound bond is preferred. The first panel 111 and the second panel 112 are sealed together using a cyanoacrylate based adhesive. In the second potential embodiment of the disclosure, the first adhesive is removed. To use the second potential embodiment of the disclosure, the second protective strip 182 is removed and the second adhesive 103 is applied to the wall 107. In this scenario, as shown most clearly in FIG. 6, the flap rectangle 117 acts as a barrier that guides and contains drill 106 waste 108 into the chamber bag 101. When work is completed, the flap rectangle 117 is folded directly onto the second adhesive 103.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Bag: As used in this disclosure, a bag is a container made of a flexible material. The bag has a single opening, which allows the bag to receive the items to be contained.

Center Axis: As used in this disclosure, the center axis is the axis of a cylinder or cone like structure. When the center axes of two-cylinder or like structures share the same line they are said to be aligned. When the center axes of two-cylinder like structures do not share the same line they are said to be offset.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Relaxed Shape: As used in this disclosure, a structure is considered to be in its relaxed state when no shear, strain, or torsional forces are being applied to the structure.

Removable Adhesive: As used in this disclosure, a removable adhesive is an commercially available adhesive that is designed with a lower tack, or stickiness, such that a first object is attached to a second object with a removable adhesive the first object can be readily removed in a manner that ideally, though not necessarily practically, leaves behind no adhesive residue on the second object. A repositionable adhesive is a subset of removable adhesives that are intended to allow the first object to be reattached to a third object or the second object in the initial or a different position. Within this disclosure, a removable adhesive is assumed to include repositionable adhesives.

Seam: As used in this disclosure, a seam is a joining of: 1) a first textile to a second textile; 2) a first sheeting to a second sheeting; or, 3) a first textile to a first sheeting.

Sheeting: As used in this disclosure, sheeting is a material, such as cloth, plastic, or paper, in the form of a thin flexible layer or layers.

Silicone: As used in this disclosure, silicone is a substance formed from silicon (Si) and oxygen (O) that forms the backbone of polymer type chains similar to polymers that are formed by carbon.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Strip: As used in this disclosure, the term describes a long and narrow object of uniform thickness that appears thin relative to the length of the object. Strips are often rectangular in shape.

Torsion Spring: As used in this disclosure, a torsion spring is a mechanical device that stores mechanical energy through an opposing torque when the mechanical device is twisted. The torsion spring will return to its original position when the twisting force is removed.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A waste container comprising:

a collection bag, a first adhesive, and a plurality of spring loaded clips;

wherein the first adhesive, and the plurality of spring loaded clips are attached to the collection bag;

wherein the waste container is a waste receptacle that is adapted for use with a tool;

wherein the waste container is adapted for use with a wall;

wherein the waste container captures and removes debris generated by the tool;

wherein the collection bag that is attached to the wall underneath a tool site such that debris generated from the tool will fall into the waste container;

wherein the waste container is disposable;

wherein the collection bag comprises a first panel, a second panel, and a plurality of seams;

wherein the plurality of seams joins the first panel and the second panel;

wherein the first panel is formed from a first sheeting;

wherein the first panel is formed in the shape of a base rectangle, a first triangle, and a second triangle;

wherein the first panel is further defined with a first edge, a second edge a third edge, a fourth edge, a fifth edge, a sixth edge, a seventh edge, an eighth edge, a first surface, and a second surface;

wherein the first triangle and the second triangle are attached to opposite edges of the base rectangle;

wherein the first triangle has a right angle formed by the sixth edge and the seventh edge of the first panel;

wherein the second triangle has a right angle formed by the fourth edge and the third edge of the first panel;

wherein the third edge and the seventh edge are aligned to form a first line;

wherein the first edge, the second edge, the eighth edge and the first line defines a rectangular sub-section contained within the base rectangle called the flap rectangle;

wherein the second panel is formed from a second sheeting;

wherein the second panel is formed in the shape of a rectangle;

wherein the second panel is further defined with a ninth edge, a tenth edge, an eleventh edge, a twelfth edge, a third surface, and a fourth surface;

wherein the plurality of seams comprises a first seam, a second seam, and a third seam;

wherein the first seam joins the fourth edge and the tenth edge;

wherein the second seam joins the fifth edge and the eleventh edge;

wherein the third seam joins the sixth edge and the twelfth edge;

wherein the first panel and the second panel are joined such that the first surface is proximal to the fourth surface;

wherein each of the plurality of spring loaded clips is a spring loaded device;

wherein each spring loaded clip selected from the plurality of spring loaded clips is attached to the first surface of the first panel;

wherein each of the plurality of spring loaded clips is further defined with a closed position and an open position;

wherein maximum torsional energy is stored within each spring loaded clip selected from the plurality of spring loaded clips when the selected spring loaded clip is in the closed position;

wherein each spring loaded clip selected from the plurality of spring loaded clips comprises a first arm, a second arm, a spring and a retaining clip;

wherein the first arm and the second arm are attached to the spring;

wherein the retaining clip holds the selected spring loaded clip in the closed position;

wherein the spring is a torsion spring;

wherein the spring is further defined with a first spring shaft and a second spring shaft;

wherein when the spring is in the relaxed shape the center axis of the first spring shaft and the center axis of the second spring shaft are perpendicular to each other;

wherein the first arm is a first rectangular block structure that is further formed with a first hole;

wherein the first hole is sized to receive the first spring shaft;

wherein the second arm is a second rectangular block structure that is further formed with a second hole;

wherein the second hole is sized to receive the second spring shaft.

2. The waste container according to claim 1 wherein when spring is positioned such that the first arm and the second arm any spring loaded clip selected from the plurality of spring loaded clips are in contact the selected spring loaded clip is in the closed position;

wherein the retaining clip holds the selected spring loaded clip in the closed position.

3. The waste container according to claim 2 wherein the plurality of spring loaded clips further comprises a first spring loaded clip and a second spring loaded clip;

wherein the first spring loaded clip is attached to the first surface of the first panel such that the first spring loaded clip will extend the first triangle at an angle perpendicularly away from the base rectangle;

wherein the second spring loaded clip is attached to the first surface of the first panel such that the second spring loaded clip will extend the second triangle at an angle perpendicularly away from the base rectangle.

4. The waste container according to claim 3 wherein the first adhesive is applied to the third surface of the second panel;

wherein the first adhesive further comprises a first protective strip.

5. The waste container according to claim 4 wherein the first adhesive is a pressure sensitive removable adhesive;

wherein the first protective strip is a silicone treated paper strip that is placed over the first adhesive.

6. The waste container according to claim 5 wherein the first panel and the second panel are formed from plastic sheeting;

wherein each of the plurality of seams is selected from the group consisting of a heat bonded seam or an ultrasonically bonded seam;

wherein the first arm, the second arm, and the retaining clip of each of the plurality of spring loaded clips is formed from molded plastic;

wherein the first adhesive is a rubber based pressure sensitive adhesive.

7. The waste container according to claim 5 wherein the first panel and the second panel are formed from paper;

wherein each of the plurality of seams is a cyanoacrylate based adhesive seam;

wherein the first arm, the second arm, and the retaining clip of each of the plurality of spring loaded clips is formed from molded plastic;

wherein the first adhesive is a rubber based pressure sensitive adhesive.

8. The waste container according to claim 5 wherein the waste container further comprises a second adhesive;

wherein the second adhesive is applied to the second surface of the first panel;

wherein the second adhesive further comprises a second protective strip.

9. The waste container according to claim 8 wherein the second adhesive is a pressure sensitive removable adhesive;

wherein the second protective strip is a silicone treated paper strip that is placed over the second adhesive.

10. The waste container according to claim 9 wherein the first panel and the second panel are formed from plastic sheeting;

wherein each of the plurality of seams is selected from the group consisting of a heat bonded seam or an ultrasonically bonded seam;

wherein the first arm, the second arm, and the retaining clip of each of the plurality of spring loaded clips is formed from molded plastic;

wherein the first adhesive is a rubber based pressure sensitive adhesive;

wherein the second adhesive is a rubber based pressure sensitive adhesive.

11. The waste container according to claim 9 wherein the first panel and the second panel are formed from paper;

wherein each of the plurality of seams is a cyanoacrylate based adhesive seam;

wherein the first arm, the second arm, and the retaining clip of each of the plurality of spring loaded clips is formed from molded plastic;

wherein the first adhesive is a rubber based pressure sensitive adhesive;

wherein the second adhesive is a rubber based pressure sensitive adhesive.

* * * * *